United States Patent [19]

Tosswill

[11] Patent Number: 4,950,939

[45] Date of Patent: Aug. 21, 1990

[54] CHANNEL ELECTRON MULTIPLIERS

[75] Inventor: Christopher H. Tosswill, Glen Cove, Me.

[73] Assignee: Galileo Electro-Optics Corp., Sturbridge, Mass.

[21] Appl. No.: 244,948

[22] Filed: Sep. 15, 1988

[51] Int. Cl.[5] ..... H01J 43/04

[52] U.S. Cl. ..... 313/103 CM; 313/105 CM

[58] Field of Search ..... 313/105 CM, 103 CM, 313/105

[56] References Cited

U.S. PATENT DOCUMENTS 3,458,745 7/1969 Shoulders ..... 313/105 CM X
3,487,258 12/1969 Manley et al. ..... 313/105 CM X
3,564,323 2/1971 Maeda ..... 313/103 CM X
3,914,634 10/1975 Overall et al. ..... 313/105
3,976,905 8/1976 Seidman et al. ..... 313/105 CM X
4,023,063 5/1977 King et al. ..... 313/105 CM X
4,482,836 11/1984 Washington et al. ..... 313/104

FOREIGN PATENT DOCUMENTS 1401969 8/1975 United Kingdom .

*Primary Examiner*—Sandra L. O'Shea

[57] ABSTRACT

Channel electron multipliers, including microchannel plates, with alternating layers of deposited conductive and insulative material, the conductive material and insulative material having, at holes therethrough in registry, secondary emission coefficients respectively of greater than one and less than one.

15 Claims, 1 Drawing Sheet

CHANNEL ELECTRON MULTIPLIERS

Field of the Invention

This invention relates to channel electron multipliers, and more particularly to such devices, especially microchannel plates, made up of an alternating multiplicity of very thin conducting layers and very thin insulating layers.

Background of the Invention

Microchannel plates with alternating conductive and insulating layers have been taught, as discussed in Washington et al. U.S. Pat. No. 4,482,836, "Electron Multipliers", granted November 13, 1984.

Summary of the Invention

I have discovered that the alternating thin conducting and insulating layers, whether or not deposited, desirably have, respectively, coefficients of secondary electron emission of respectively greater than and less than unity.

In preferred embodiments, a multiplicity of successively deposited thin film layers, and resistance is provided through annuli surrounding insulating layer portions and abutting conducting layer portions.

PREFERRED EMBODIMENT

Figure 1:
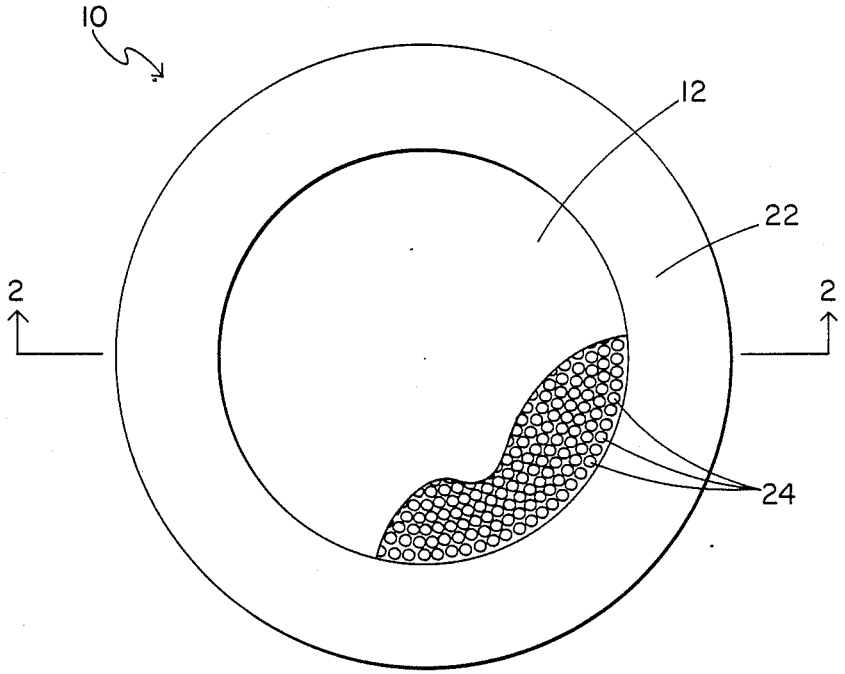
FIG. 1 is a diagrammatic plan view of a microchannel plate according to the invention.
Figure 2:
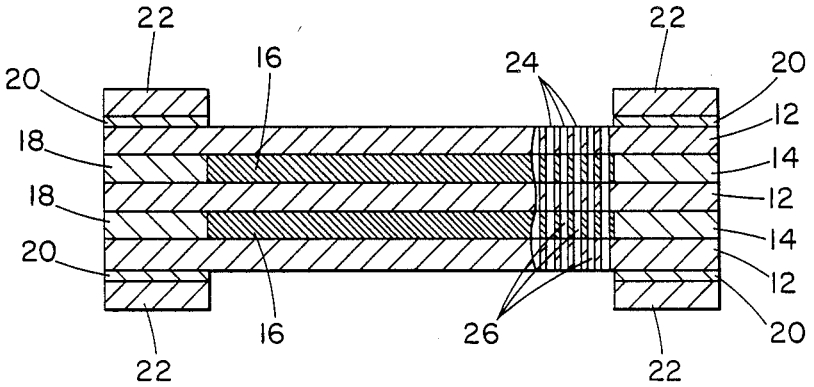
FIG. 2 is a diagrammatic cross-sectional view, partially broken away, taken at 2—2 of FIG. 1.

There is shown in FIGS. 1 and 2 a microchannel plate 10 according to the invention.

MCP 10 is made up of alternating layers 12 and 14.

Layers 12 are of silver, 10 microns thick and 50 millimeters in diameter, with a perforated inner cylindrical portion and an imperforate annulus. The inner portion is 40 mm. in diameter, and thus surrounded by a coaxial annulus 5 mm. in radial width. The holes in the inner portion are 25 microns in diameter, and on 30 micron centers, so that minimum wall thickness therebetween is about 5 microns. The hole inner surfaces are coated with a reduced reaction product of silver, cesium, and oxygen, well known in the photocell art, that has a typical secondary electron emission coefficient of about 5 (i.e., above one) under the conditions hereinafter set forth. Hemenway et al., "Physical Electronics" (Wiley, 1962), p. 65, said:

"One of the best known emitters is cesium oxide Partly reduced on a base of silver."

Layers 14 have an inner cylindrical core 16 which is 40 mm. in diameter and 10 microns thick, of ordinary soda-lime glass with a resistivity of about $10^{12}$ ohm-centimeters. Extending through this core also are holes 25 microns in diameter, on 30-micron centers, in registry with the layer 12 holes. These holes in core 16 have a secondary-electron emission coefficient of about 0.5 under the conditions hereinafter set forth (i.e., below one). (If need be, these holes can be roughened after being punched and before the cesium vapor deposition hereinafter described.) Surrounding core 16 is imperforate annulus 18, 5 mm. in radial width and 10 microns thick, and of vanadium-phosphate glass (25 mol % $V_2O_5$, 75 mol % $P_2O_5$); overall resistance through annuli 18 is $10^6$ ohms. How resistance of this sort of glass varies with the ratio of the two ingredients is discussed in Adler, "Amorphous Semiconductors", October 1971 CRC Critical Reviews in Solid State Sciences 317, at p. 407.

Although FIG. 2 is diagrammatic and shows only three layers 12 and two layers 14, there are actually 50 layers 12 and 49 layers 14, alternating (with the outside layers both layers 12), so that the total thickness of the multiplying part of the MCP is about 1 mm.

Deposited over the outer annular portions of the two outer layers 12 are rings 20 of nichrome, one micron in thickness.

Secured by clamp to these rings 20 are copper rings 22, which are 5 mm. thick. These rings provide not only electrical contact, but mechanical strength and thermal relief as well.

The overall thickness of the device shown is thus about 11 mm.

Manufacture

MCP 10 is made by successively depositing layers 12 and 14, by vapor deposition, on a substrate of etchable glass (weight percent 46.7 BaO, 18 $SiO_2$, 31 $B_2O_3$, 3 $K_2O$, 1 $Al_2O_3$, 0.3 $As_2O_5$) 1 mm. thick. Cores 16 and annuli 18 are of course separately masked.

Following all these depositions, the substrate is dissolved, using a 10% solution of hydrochloric acid.

The final depositions then are of nichrome rings 20.

Holes 24, 26 in layers 12, 14 are then simultaneously punched by laser, so that registration is automatic.

Holes 24 in silver layers 12 are then reacted with cesium (in vapor phase) and oxygen and reduced with hydrogen, to produce in holes 24 the surface above mentioned.

Operation

A voltage drop of 1000 volts is provided across copper rings 22.

In operation, the resistance in each annulus 18 is about 20,000 ohms, so that the overall annular resistance is about 1,000,000 ohms. The resistance through the core elements 16 is several orders of magnitude greater, so that current flow is essentially through the annular portions 18, and the highly conductive silver layers 12 therebetween.

Because the insulating layers have a secondary emission coefficient less than (usually preferably much less than) one, they will shortly after multiplication begins in each use fall to such a low potential that by repelling they will prevent further impact on them of electrons, leaving only the conductive layers to act in electron collection or emission. The latter layers, because of being locked to a strip current in the way they are, remain at uniform axial field rather than building up to the multiplying-destroying fields of the prior art.

The insulating layer must be carefully chosen to have, in use (for the coefficient of secondary electron emission varies with, for example, roughness and voltage), a coefficient of less than one.

Since the overall voltage is 1000, heat generated is about one watt. Because of the annular or sleeve-like nature of the zone where the heat is generated, however, it is easily disposed of, with the help of a fan if desired. Indeed, considerable additional heat could be readily disposed of without cumbersome and expensive heat sinks, if desired.

Moving the location of the strip current from the walls of the channels toward the outside of the microchannel plate enables better handling of generated heat, which raises the channel-recovery upper limit on dynamic range, making possible much increased operating frequencies.

My invention makes possible other advantages.

My laser-punched embodiments permit control of both hole shape and location with a precision not possible in the prior art, and may facilitate devices capable of performing parallel-process on two-dimensional digital data assemblies.

By separating as my invention does resistance and multiplication paths, it permits use for resistance of materials with a positive temperature coefficient (as by substituting for the vanadium-phosphate glass rings as the functional resistance a metal layer sputtered on the outside diameter of the MCP according to my invention).

Cooling into the range needed by infrared imaging systems may be made practical.

My invention permits avoiding the cumbersome use of channel curvature to trap positive ions (as, by laser-punching at a slight angle to perpendicularity to layers).

My invention allows use of materials with higher coefficients of secondary emission gain (for example, my preferred embodiment conductive layers 12 provide coefficients more than twice those practical with devices of the practical prior art), thus making possible use of lower MCP voltage drops.

My invention makes possible use of different emission surfaces at different points along channel length. Thus, cesium-oxygen-silver may be used near the inlet for high gain, and nickel near the outlet for durability.

Other Embodiments

The layers 12 or 14 may be deposited in any suitable way, as also by sputtering or epitaxially.

Claims

Other embodiments of the invention are within the following claims:

I claim:

1. A channel electron multiplier comprising:

a multiplicity of first layers, each first layer of said first layers comprising at least one path of high conductivity and at least one amplifying hole through said layer, the inner surface of said amplifying hole having a coefficient of secondary electron emission above 1, and a plurality of second layers, each second layer of said second layers including at least one insulating portion and at least one passive hole through said insulating portion, the inner surface of said passive hole having a coefficient of secondary emission below 1, said amplifying hole and said passive hole being in registry, whereby, during operation, said inner surfaces of said passive holes fall to low potential and repel further input of electrons on them, and only said inner surfaces of said amplifying holes act in electron collection and emission.

2. The channel electron multiplier of claim 1 in which each said second layer includes at least one resistive portion, and said path of high conductivity and said resistive portion are abutting.

3. The channel electron multiplier of claim 2 which comprises an alternating multiplicity of said first layers and said second layers.

4. A microchannel plate according to claim 3, and including in each of said layers a multiplicity of holes, amplifier holes and passive holes of different layers being in registration.

5. The microchannel plate of claim 1 or 4 in which said layers are deposited layers.

6. The microchannel plate of claim 4 in which said first layers are of metal.

7. The microchannel plate of claim 6 in which said metal is silver.

8. The microchannel plate of claim 6 in which surfaces inside the amplifier holes are of reduced complex of silver-cesium oxide.

9. The microchannel plate of claim 4 in which said second layers have a cylindrical central portion that is insulating in nature, and therearound an annular resistive portion.

10. The microchannel plate of claim 9 in which said central portion is of soda glass and said annular resistive portion is of vanadium-phosphate glass.

11. The microchannel plate of claim 10 in which said vanadium-phosphate glass is 25 mol % $V_2O_5$ and 75 mol % $P_2O_5$.

12. The microchannel plate of claim 4 in which said first layers vary in character therewithin.

13. The microchannel plate of claim 4 in which said holes are related to one another in a precisely predetermined pattern.

14. The microchannel plate of claim 4 in which said holes are at an angle other than 90° to said layers.

15. A microchannel plate comprising a multiple-layer assembly of alternating layers of conductive material and insulating material, said layers having a plurality of holes through said layers, said holes having first inner surfaces at conductive material layers that have coefficients of secondary electron emission above 1, said holes having second inner surfaces at insulating material layers that have coefficients of secondary electron emission below 1, whereby, during operation, said second inner surfaces fall to low potential and repel further input of electrons on them, and only said second inner surfaces act in electron collection and emission.

* * * * *